United States Patent [19]

Depiereux

[11] Patent Number: 4,564,429

[45] Date of Patent: Jan. 14, 1986

[54] METHOD OF ELECTROCHEMICALLY ROUGHENING ALUMINIUM SURFACES IN THE MANUFACTURE OF OFFSET PRINTING PLATES

[76] Inventor: Wolf-Rüdiger Depiereux, Allemannenweg 3, 5160 Düren, Fed. Rep. of Germany

[21] Appl. No.: 658,808

[22] Filed: Oct. 9, 1984

[30] Foreign Application Priority Data

Oct. 29, 1983 [DE] Fed. Rep. of Germany ..... 3339410

[51] Int. Cl.[4] ..... C25F 3/04

[52] U.S. Cl. ..... 204/129.75

[58] Field of Search ..... 204/129.75, 129.8, 129.1, 204/206

[56] References Cited

U.S. PATENT DOCUMENTS

| | | | |
|---|---|---|---|
| 4,166,015 | 8/1979 | Raether | 204/129.75 |
| 4,416,972 | 11/1983 | Walls | 204/129.75 |
| 4,432,854 | 2/1984 | Takahashi | 204/206 |

FOREIGN PATENT DOCUMENTS

| | | | |
|---|---|---|---|
| 2149899 | 4/1972 | Fed. Rep. of Germany | 204/129.75 |
| 3222170 | 1/1983 | Fed. Rep. of Germany | 204/129.75 |
| 0089508 | 2/1983 | Fed. Rep. of Germany | 204/129.75 |

*Primary Examiner*—T. M. Tufariello

*Attorney, Agent, or Firm*—Finnegan, Henderson, Farabow, Garrett & Dunner

[57] ABSTRACT

In a method of electrochemically roughening aluminium surfaces in the manufacture of offset printing plates, use is made of an electrolyte containing nitric acid, boric acid and water. Alternating current is employed and the material to be roughened is passed as a continuous band through the electrolyte. The electrolyte contains from three to fifteen g/l of aluminium. The current density employed is between 15 and 90 $A/dm^2$.

12 Claims, No Drawings

METHOD OF ELECTROCHEMICALLY ROUGHENING ALUMINIUM SURFACES IN THE MANUFACTURE OF OFFSET PRINTING PLATES

The invention relates to a method of electrochemically roughening aluminium surfaces in the manufacture of offset printing plates using an electrolyte containing nitric acid, boric acid and water under alternating current.

To make offset printing plates, it is known to perform electrochemical roughening on individual plates or bands of aluminium or aluminium alloys which, on conclusion of the process, are divided into individual plates, thereafter to anodise and therefore stabilise them in a further electrolyte, and finally to provide the surfaces thus treated with a photosensitive coating. The surface roughness primarily serves to facilitate secure anchoring of the coating on the plate and the guiding of water at the places free from images in the printing press.

With regard to the surface roughness, there is first of all the requirement that it should be homogeneous over the entire surface and that individual groove-like depressions are excluded. In addition, there are, depending on the specific use, different requirements for the printing plates as far as the fineness, i.e. the pore size, of the surface roughness is concerned.

The surface roughness is determined by a multiplicity of parameters of the method employed. Of particular importance are the composition of the electrolyte, its temperature, the current density and the duration of the individual plate or the continuously transported band within the electrolyte. However, what is to be noted is that the combination of these parameters valid for a particular method cannot be varied at will without the danger of producing useless products of the process. In addition, it is time consuming and costly to change the values of the electrolytes, e.g. the temperature and composition of the bath, in an existing plant during operation to achieve different surface parameters corresponding to the different requirements of the printing industry.

Thus, a method of uniformly and finely electrolytically or electrochemically roughening aluminium surfaces is known (DE-PS No. 21 49-899), which provides for an electrolyte containing 0.5 to 2 percent by weight of hydrochloric acid or 0.5 to 3 percent by weight of nitric acid and 0.1 to 1.5 percent by weight of boric acid, the intended current density being from 0.5 to 10 A/dm$^2$. In this method, individual plates are moved through the electrolyte in sequence, the duration in the electrolyte amounting to five minutes. Now, a considerable change in the roughness values as required for certain printing processes cannot be achieved in this known method by increasing the proportion of acid and/or increasing the current density. Such a change in these parameters would lead to an irregular and therefore useless surface structure.

Further, there is known a method of electro-chemically roughening aluminium and its use as a carrier material for offset printing plates (DE-OS No. 32 22 170), wherein an aqueous electrolyte is employed containing hydrogen peroxide in addition to hydrochloric acid and/or nitric acid. The electrolyte may additionally contain aluminium chloride and/or aluminium nitrate. According to this publication, the use of boric acid as an additive to nitric acid does not lead to surfaces which are adequate for the requirements placed on them in the printing plate industry.

The aim of the known method is to produce an aluminium carrier with a fine roughened surface free from pock marks. Accordingly, it is not also intended or suitable for the production of a coarser surface.

Further, a method for electrolytic roughening aluminium and its use as a carrier material for offset printing plates is known (EP-OS No. 0 089 508), wherein use is made of an electrolyte that must necessarily contain nitric acid and oxalic acid. Additives contained in the electrolyte may be boric acid, aluminium nitrate and/or hydrogen peroxide. Again, according to this specification the addition of boric acid to nitric acid will not lead to surfaces which are adequate particularly for the requirements in the printing plate industry.

The preceeding remarks concerning DE-OS No. 32 22 170 apply to the surface roughness achievable by this known method.

The present invention is based on the problem of providing a method of the aforementioned kind such, that at a high production rate, in the production of offset printing plates a uniform surface roughness can be elected with simple means between a fine and coarse value.

This problem is solved in a method of the aforementioned kind in that the material to be roughened is passed as a continuous band through the electrolyte, that the electrolyte contains 3 to 15 g/l of aluminium, and the current density is between 15 and 90 A/dm$^2$.

By keeping the proportion of aluminium constant in the electrolyte at a particular value within the stated range, it is surprisingly possible to vary the current density within the stated wide limits and, contrary to the fear expressed in the prior art, to achieve a uniform surface roughness which may be fine or coarse as desired and corresponds to the requirements of the printing industry. It is of particular advantage that a desired change in the surface roughness can be achieved solely by varying the current density with the current density being the parameter of the method that can be changed most easily. Since this method also provides for the passage of the material to be roughened in the form of a continuous band, high production rates are achievable. The possibility of using elevated current densities leads to a considerable reduction in the period of dwell and thus to increase productivity.

Advantageous developments of the method are the subject of the subsidiary claims.

The following description provides a few examples of the method according to the invention.

EXAMPLE 1

Composition of the electrolyte:
Nitric Acid 8.5 g/l
Boric Acid 10.0 g/l
Aluminium 5.0 g/l
Temperature of the electrolyte 40° C.
Duration of treatment 60 seconds
Four current densities were successively employed, the individual current densities resulting in the following arithmetic mean values of roughness Ra:

| | | |
|---|---|---|
| 1. | Current density 20 A/dm$^2$ | Ra = 0.45 μm |
| 2. | Current density 30 A/dm$^2$ | Ra = 0.49 μm |
| 3. | Current density 40 A/dm$^2$ | Ra = 0.55 μm |

-continued

| | | |
|---|---|---|
| 4. | Current density 60 A/dm$^2$ | Ra = 0.99 μm |

EXAMPLE 2

Nitric Acid 6.5 g/l
Boric Acid 5.5 g/l
Aluminium 5.0 g/l
Temperature of electrolyte 40° C.
Duration of treatment 60 seconds Three current densities were employed successively, the individual current densities resulting in the following arithmetic mean values of roughness Ra:

| | | |
|---|---|---|
| 1. | Current density 20 A/dm$^2$ | Ra = 0.39 μm |
| 2. | Current density 30 A/dm$^2$ | Ra = 0.55 μm |
| 3. | Current density 40 A/dm$^2$ | Ra = 0.97 μm |

EXAMPLE 3

Nitric Acid 6.5 g/l
Boric Acid 10.0 g/l
Aluminium 5.0 g/l
Temperature of electrolyte 40° C.
Duration of treatment 36 seconds Five current densities were employed successively, the individual current densities resulting in the following arithmetic mean values of roughness Ra:

| | | |
|---|---|---|
| 1. | Current density 30 A/dm$^2$ | Ra = 0.33 μm |
| 2. | Current density 40 A/dm$^2$ | Ra = 0.46 μm |
| 3. | Current density 50 A/dm$^2$ | Ra = 0.63 μm |
| 4. | Current density 60 A/dm$^2$ | Ra = 0.89 μm |
| 5. | Current density 70 A/dm$^2$ | Ra = 1.21 μm |

I claim:

1. A method of electrochemically roughening the surfaces of aluminium material comprising passing the material to be roughened as a continuous band through an electrolyte bath consisting essentially of nitric acid, boric acid, water and from 3 to 15 g/l of aluminium under an alternating current and varying the degree of surface roughness from fine to coarse by varying the density of the alternating current from 15 and 90 A/dm$^2$.

2. The method of claim 1 in which the electrolyte contains 4 to 15 g/l nitric acid and 3 to 12 g/l boric acid and the time for passing the band of material through the electrolyte is between 20 and 90 seconds.

3. The method of claim 2 in which the temperature of the electrolyte is between 30° and 55° C.

4. The method of claim 1 in which the temperature of the electrolyte is between 30° and 55° C.

5. The method of claim 1 or claim 2 in which the electrolyte contains 6 to 10 g/l nitric acid, 5 to 10 g/l boric acid and 5 to 8 g/l aluminium and the time for passing the band of material through the electrolyte is 30 to 60 seconds.

6. The method of claim 5 in which the temperature of the electrolyte is between 30° and 55° C.

7. The method of claim 6 in which the temperature of the electrolyte is 40° C.

8. The method of claim 6 in which the current density is between 20 and 70 A/dm$^2$.

9. The method of claim 1 in which the current density is between 20 and 70 A/dm$^2$.

10. The method of claim 1 in which the electrolyte contains 8.5 g/l nitric acid, 10.0 g/l boric acid and 5.0 g/l aluminium and the current density is between 20 and 60 A/dm$^2$ during a treatment lasting 60 seconds.

11. The method of claim 1 in which the electrolyte contains 6.5 g/l nitric acid, 5.5 g/l boric acid and 5.0 g/l aluminium and the current density is between 20 and 40 A/dm$^2$ during a 60 second treatment period.

12. The method of claim 1 or 2 in which the electrolyte contains 6.5 g/l nitric acid, 10.0 g/l boric acid and 5.0 g/l aluminium and the current density is between 30 and 70 A/dm$^2$ during a treatment period of 36 seconds.

* * * * *